US009184548B2

(12) United States Patent
Hutchfield et al.

(10) Patent No.: US 9,184,548 B2
(45) Date of Patent: Nov. 10, 2015

(54) HAND OPERATED CRIMPING TOOL

(75) Inventors: John Hutchfield, Sudbury (GB); Lars Olov Persson, Alvdalen (SE); Niklas Jonasson, Mora (SE)

(73) Assignee: Pressmaster AB, Alvdalen (SE)

( * ) Notice: Subject to any disclaimer, the term of this patent is extended or adjusted under 35 U.S.C. 154(b) by 741 days.

(21) Appl. No.: 13/446,210

(22) Filed: Apr. 13, 2012

(65) Prior Publication Data

US 2012/0260481 A1 Oct. 18, 2012

(30) Foreign Application Priority Data

Apr. 15, 2011 (SE) ..... 1100285

(51) Int. Cl.
*B25B 27/14* (2006.01)
*H01R 43/042* (2006.01)

(52) U.S. Cl.
CPC ..... *H01R 43/042* (2013.01); *B25B 27/146* (2013.01); *Y10T 29/539* (2015.01)

(58) Field of Classification Search
CPC ... B25B 27/146; H01R 43/042; Y10T 29/539
USPC ..... 29/268; 81/342, 333, 329, 362, 363, 81/109, 355; 72/404, 409.1, 409.12
See application file for complete search history.

(56) References Cited

U.S. PATENT DOCUMENTS 1,475,273 A * 11/1923 Bernard ..... 30/184
2,762,414 A 11/1953 Demler
2,722,859 A 11/1955 Stoltz
2,765,019 A 10/1956 Evans
2,772,715 A 12/1956 Neijstrom et al.
2,928,299 A * 3/1960 Fuller ..... 72/403
3,029,670 A 4/1962 Over et al.
3,840,987 A 10/1974 Netta
RE30,848 E 1/1982 Bauerkemper
4,571,764 A * 2/1986 Chen et al. ..... 7/107
5,152,051 A 10/1992 Folk et al.
5,253,508 A 10/1993 Bakermans
5,335,530 A 8/1994 Homm
5,913,933 A * 6/1999 Beetz et al. ..... 72/409.16
6,026,671 A * 2/2000 Battenfeld ..... 72/409.12
6,044,686 A 4/2000 Dischler (Continued)

FOREIGN PATENT DOCUMENTS

EP 2 362 501 A1 8/2011
FR 2 725 650 A1 4/1996

(Continued)

*Primary Examiner* — Lee D Wilson
*Assistant Examiner* — Henry Hong
(74) *Attorney, Agent, or Firm* — Dickstein Shapiro LLP

(57) ABSTRACT

A hand operated crimping tool comprising a body arranged between a distal end and a proximal end of the crimping tool, a tool head arranged distally on the crimping tool, and handles arranged proximally on the crimping tool, where at least one handle is pivotally arranged, and where the relative movement of the tool handles is connected to the relative movement of crimping dies, between which crimping dies at least one workpiece is arranged to be crimped. The tool head comprises a main head part and a pivotable head part, where the movement of the pivotally arranged handle(s) is connected to the movement of the pivotable head part via the body and a mechanism, whereby the pivotable head part of the tool head is movable between an open head position and a closed head position depending on the relative position of the tool handles.

31 Claims, 10 Drawing Sheets

(56) References Cited

U.S. PATENT DOCUMENTS

| | | | | |
|---|---|---|---|---|
| 6,085,422 | A | 7/2000 | Hirabayashi | |
| 6,324,884 | B1 | 12/2001 | Barjesteh et al. | |
| 2002/0056309 | A1* | 5/2002 | Beetz et al. | 72/409.16 |
| 2004/0079132 | A1 | 4/2004 | Frenken | |
| 2008/0196473 | A1 | 8/2008 | Chiasson et al. | |
| 2011/0197648 | A1* | 8/2011 | Houser et al. | 72/452.1 |

FOREIGN PATENT DOCUMENTS

| | | | |
|---|---|---|---|
| GB | 585 313 | A | 2/1947 |
| GB | 2 185 706 | A | 7/1987 |

* cited by examiner

HAND OPERATED CRIMPING TOOL

FIELD OF THE INVENTION

The present invention relates to a hand operated crimping tool.

BACKGROUND OF THE INVENTION AND RELATED ART

When crimping, a connector i.e. a terminal, splice, contact or a similar device is mechanically secured to at least one cable—e.g to a conductor such as a wire—by deformation so that a solid joint having reliable mechanical and electrical connection is formed. The crimping operation resulting in a crimped joint is performed using crimping dies. Crimping tools may e.g. be hand operated.

In hand operated hand held crimping tools, the crimping tool is usually arranged with two proximally on the crimping tool arranged handles which are movable in relation to each other, where when the user brings the handles towards each other using hand force, usually using one hand only which when placed around both of the handles is squeezed together, the usually distally on the crimping tool arranged crimping dies are brought together in order to crimp at least one workpiece between them.

Crimping tools of the above mentioned kind may be arranged with an open head or a closed head. In a tool having an open head, the head has to be much stronger than in a tool having a closed head in order to withstand the same amount of maximum crimping force, this due to that an open head design is less rigid than a closed head design and will flex more easily during crimping.

A crimping tool with a closed head will thus be lighter than a crimping tool with an open head designed for the same amount of maximum crimping force if the crimping tools are made of the same material, this resulting in less load on the user.

A crimping tool with an open head shows on the other hand the advantage that it is possible to e.g. crimp together the ends of two very long wires and thereafter to remove the crimping tool away from the crimped wires without having to pull the crimped wires through the head of a crimping tool as in a tool having a closed head. Further, if the "non-crimped" ends of the two crimped wires are not free which e.g. is the case when these ends already are fixed to e.g. a respective electrical distribution box, it is impossible to remove the crimped wires after crimping from a tool having a closed head.

DE 298 03 336 U1 shows a hand crimping tool with a head which head may be opened up when crimping is not in progress in order to be able to move a workpiece sideways into the head and in order to facilitate the exchange of crimping dies. The head is kept closed during crimping.

SUMMARY OF THE INVENTION

The primary object of the present invention is to provide an improved hand operated crimping tool, the improved hand operated crimping tool thereby making use of the above mentioned advantages of both hand crimping tools having open heads and hand crimping tools having closed heads. The above mentioned object is achieved for a hand operated crimping tool comprising a body, at least one pivotally arranged handle, a main head part, and a pivotable head part, where the movement of the at least one pivotally arranged handle is connected to the movement of the pivotable head part via the body and a mechanism, the pivotable head part thus being automatically movable between an open head position and a closed head position depending on the relative position of the tool handles without the user of the tool having to manually and separately move the pivotable tool head part between an open head position and a closed head position.

According to one embodiment, the at least one pivotally arranged handle is pivotally arranged to the body, and the main head part is arranged axially slidable along the body.

According to another embodiment, the at least one pivotally arranged handle is pivotally arranged to the main head part, and the body is arranged axially slidable along the main head part.

According to a further embodiment, the at least one pivotally arranged handle is pivotally arranged to the body, and the body and the main head part are arranged fixed to each other.

According to one embodiment, the mechanism is arranged to connect the movement of the at least one pivotally arranged handle to the movement of the main head part and the movement of the pivotable head part.

According to one embodiment, the mechanism is arranged to connect the movement of the at least one pivotally arranged handle to the movement of the body and the movement of the pivotable head part.

According to one embodiment, the mechanism is arranged to connect the movement of the at least one pivotally arranged handle to the movement of the pivotable head part.

According to one embodiment, the mechanism is a toggle mechanism.

According to one embodiment, the mechanism is a cam mechanism.

According to one embodiment, the main head part is arranged slidably attached to the body using at least one pin arranged to slide in at least one slot extending axially along the tool.

According to one embodiment, the pivotable head part is arranged to be slidably guided along a curved path along the body by using at least one pin arranged to slide in a curved slot defining the curved path.

According to one embodiment, the body comprises two body parts between which the main head part is arranged.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
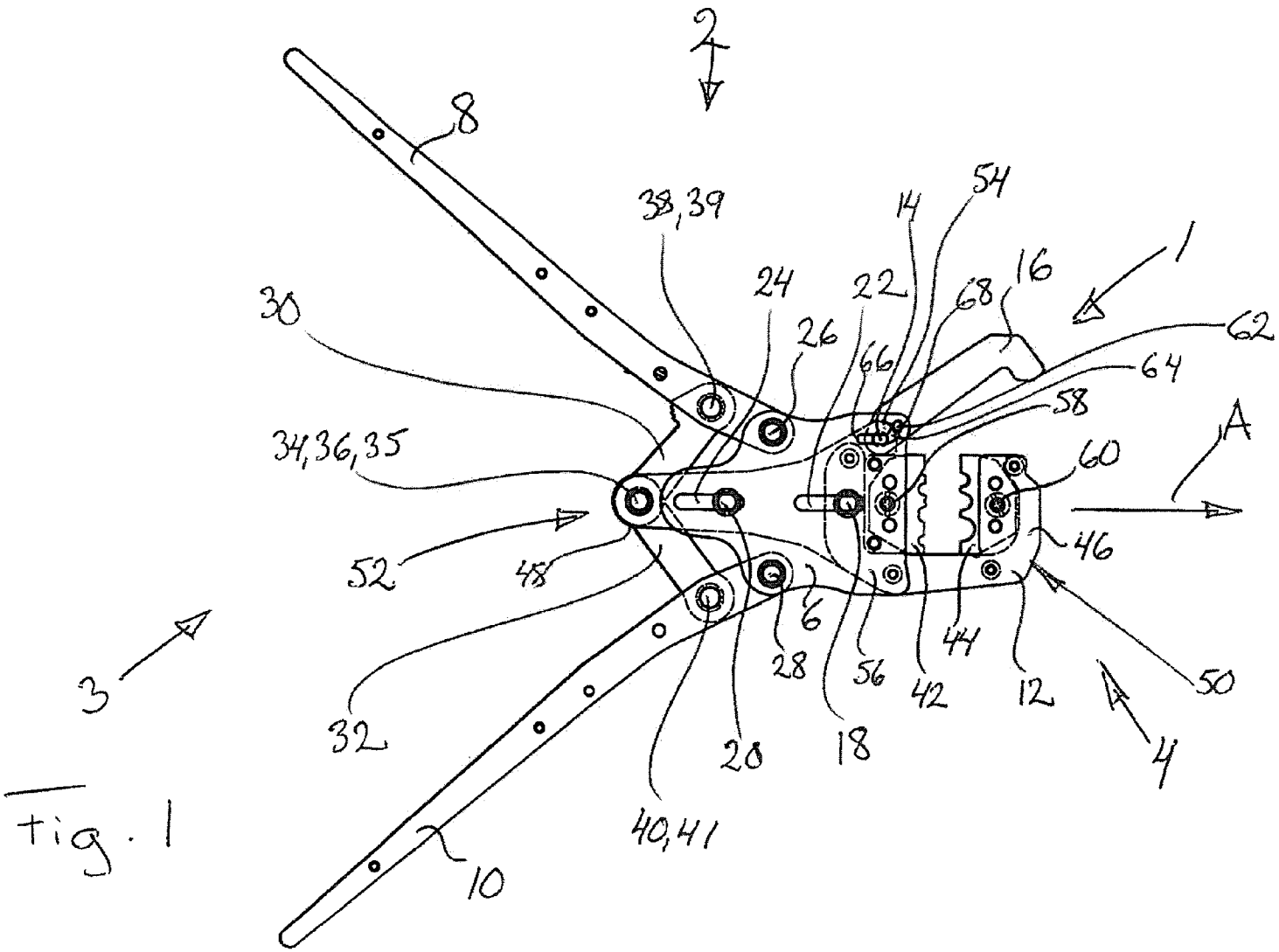
FIG. 1 shows schematically a side view of a hand operated crimping tool having a tool head with a pivotable head part according to a first embodiment of the invention, shown in an open head position.

The same reference numerals are being used for similar features in the different drawings.

FIG. 1 shows schematically a side view of a hand operated crimping tool 2 having a tool head 4 with a pivotable head part according to a first embodiment of the invention, shown in an open head position. The open head position is the non-crimping position. The crimping tool 2 also comprises a body 6 and two handles 8, 10. The body 6 is arranged between the distal end 1 and the proximal end 3 of the crimping tool 2. The tool head 4 is arranged distally 1 on the crimping tool 2, and the two handles 8, 10 are arranged proximally 3 on the crimping tool 2. The tool head 4 comprises a main head part 12 and a pivotably thereto at a pivot point 14 attached pivotable latch-like head part 16, where the main head part 12 is arranged to extend along the body 6 and is slidably attached to the body 6 using pins 18, 20 arranged to slide in respective slots 22, 24 extending axially A along the tool 2, where preferably at least two pins 18, 20 are used in order to control the movement of the main head part 12 relative to the body. The slots 22, 24 may be arranged in the body 6 or in the main head part 12, and the pins may be arranged in the main head part 12 or in the body 6, respectively. The handles 8, 10 are pivotably attached to the body 6 at pivot points 26, 28. The handles 8, 10 are further connected to the main head part 12 by respective toggles 30, 32 which toggles 30, 32 are pivotably attached to the main head part 12 and a respective handle 8, 10 at pivot points 34, 36; 38, 40, preferably by using pins 35; 39, 41. The movement of the pivotally to the body 6 arranged handles 8, 10 is thus arranged connected to the movement of the main head part 12 and the pivotable head part 16 by a mechanism 31, here a toggle mechanism, whereby the pivotable head part 16 of the tool head 4 is arranged movable between an open head position and a closed head position depending on the position of the tool handles 8, 10. The main head part 12 is arranged axially A slidable along the body 6. Crimping dies 42, 44 are further, preferably removably, arranged at the body 6 and the main head part 12, respectively, between which crimping dies 42, 44 at least one workpiece (not shown in this figure) is arranged to be crimped when the crimping dies 42, 44 are moved towards each other. The relative movement of the tool handles 8, 10 is connected to the relative movement of the crimping dies 42, 44. For better understanding of the invention, the parts of the crimping dies 42, 44 which are obscured e.g. by the body 6 or the main head part 12 are shown with dashed lines in the figure.

The main head part 12 may comprise more than one part, e.g. at least one distal part 46 and at least one proximal part 48. The crimping die 44 may be arranged at the distal end 50 of the distal part 46 and the toggles 30, 32 may be pivotably attached to the proximal end 52 of the proximal part 48. The distal end 54 of the proximal part 48 may be attached to the proximal end 56 of the distal part 46. The pivotable head part 16 may further be pivotably attached at a pivot point 14 to the distal end 54 of the proximal part 48. The distal part 46 may be essentially U-shaped and the proximal part 48 may be essentially Y-shaped.

Said, preferably exchangeable, crimping dies 42, 44 may further preferably be removably fastened at the body 6 and the main head part 12, respectively, by respective fastening elements 58, 60 such as screws.

In order to achieve that the pivotable head part 16 of the tool head 4 is automatically moved between an open head position and a closed head position depending on the relative position of the tool handles 8, 10 as will be discussed in more detail below, the pivotable head part 16 is further arranged to be slidably guided along a curved path along the body 6 by using at least one pin 62 arranged to slide in a curved slot 64, the curved slot 64 defining the curved path. The curved slot 64 may be arranged in the body 6 or in the pivotable head part 16, and at least one pin 62 may be arranged in the pivotable head part 16 or in the body 6, respectively.

According to this embodiment, the curved slot 64 is arranged in the body 6 and the at least one pin 62 is arranged in the pivotable head part 16, where further the curved slot 64 is arranged at its proximal end 66 to extend in parallel with the above mentioned slots 22, 24 extending axially A along the tool 2, whereas the curved slot 64 is arranged towards its distal end 68 to extend at an angle to and away from the above mentioned slots 22, 24. Thus, when the pin 62 arranged in the pivotable head part 16 moves along the curved slot 64 in parallel to the above mentioned slots 22, 24, the pivotable head part 16 of the tool head 4 is kept in its closed position. When the pin 62 arranged in the pivotable head part 16 moves along the curved slot 64 at an angle to and away from the above mentioned slots 22, 24, the pivotable head part 16 of the tool head 4 leaves its closed position and opens up. When the pin 62 reaches its most distal position along the curved slot 64, the pivotable head part 16 of the tool head 4 has reached its open position.

Figure 2:
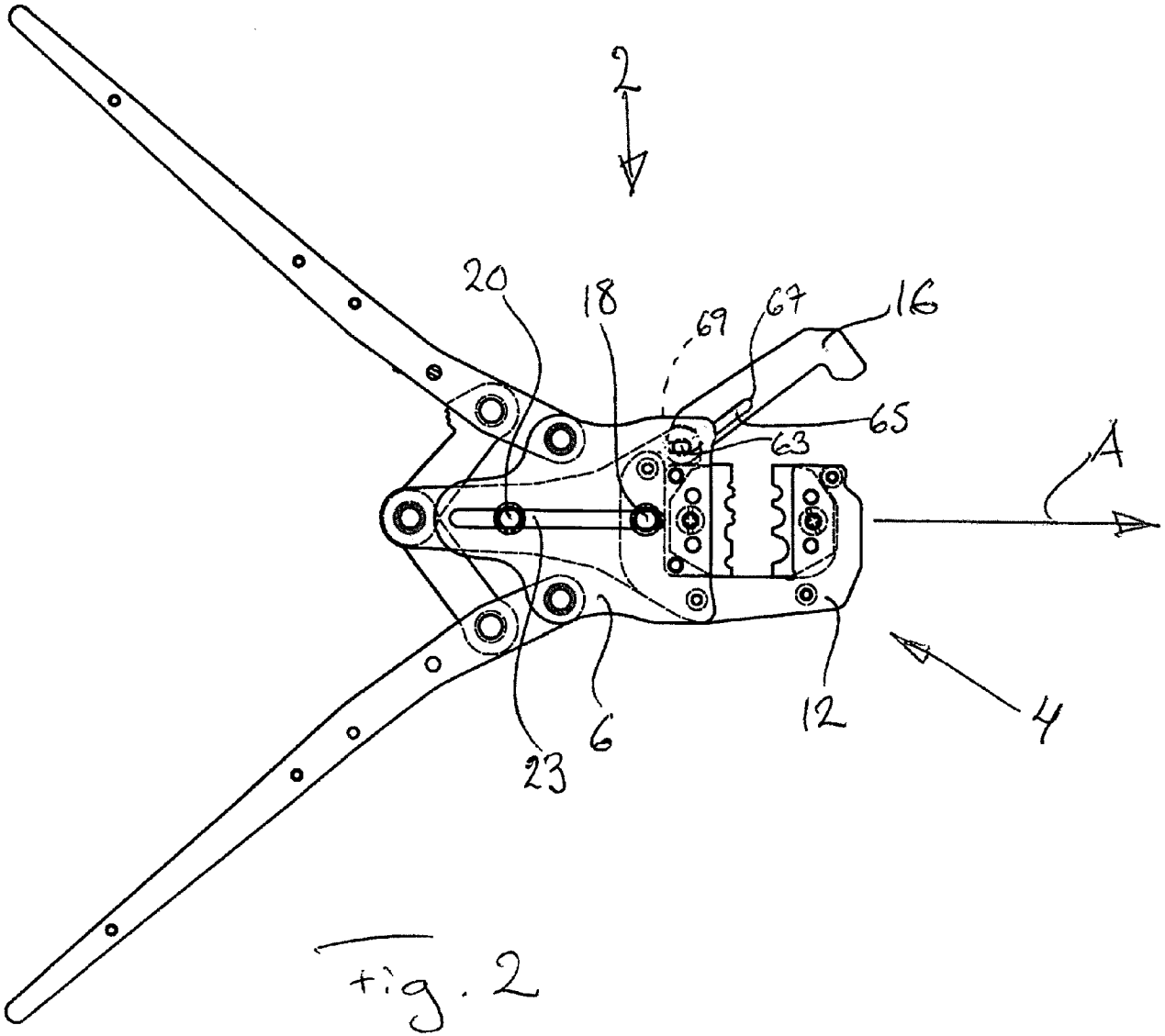
FIG. 2 shows schematically a side view of a hand operated crimping tool having a tool head with a pivotable head part according to a second embodiment of the invention, shown in an open head position.

FIG. 2 shows schematically a side view of a hand operated crimping tool 2 having a tool head 4 with a pivotable head part 16 according to a second embodiment of the invention, shown in an open head position.

The embodiment shown in FIG. 2 differs from the embodiment shown in FIG. 1 in that the main head part 12 is slidably attached to the body 6 using pins 18, 20 arranged to slide in one slot 23 extending axially A along the tool 2. The slot 23 may be arranged in the body 6 or in the main head part 12, and the pins may be arranged in the main head part 12 or in the body 6, respectively.

The embodiment shown in FIG. 2 further differs from the embodiment shown in FIG. 1 in that the curved slot 65 is arranged in the pivotable head part 16 and the at least one pin 63 is arranged in the body 6, the curved slot 65 is in the closed position of the pivotable head part 16 of the tool head 4 arranged at its distal 67 end to extend in parallel with the above mentioned slot 23 extending axially A along the tool 2, and arranged towards its proximal end 69 to extend at an angle to the distal end 67 of the curved slot 65 and away from the above mentioned slot 23. Thus, when the pin 63 arranged in the body 6 moves along the distal end 67 of the curved slot 65, the pivotable head part 16 of the tool head 4 is kept in its closed position until the pin 63 reaches the point where the curved slot 65 curves and begins to extend at an angle to the distal end 67 of the curved slot 65 whereby the pivotable head part 16 of the tool head 4 leaves its closed position and opens up. When the pin reaches its most proximal position along the curved slot 65, the pivotable head part 16 of the tool head 4 has reached its open position.

Figure 3:
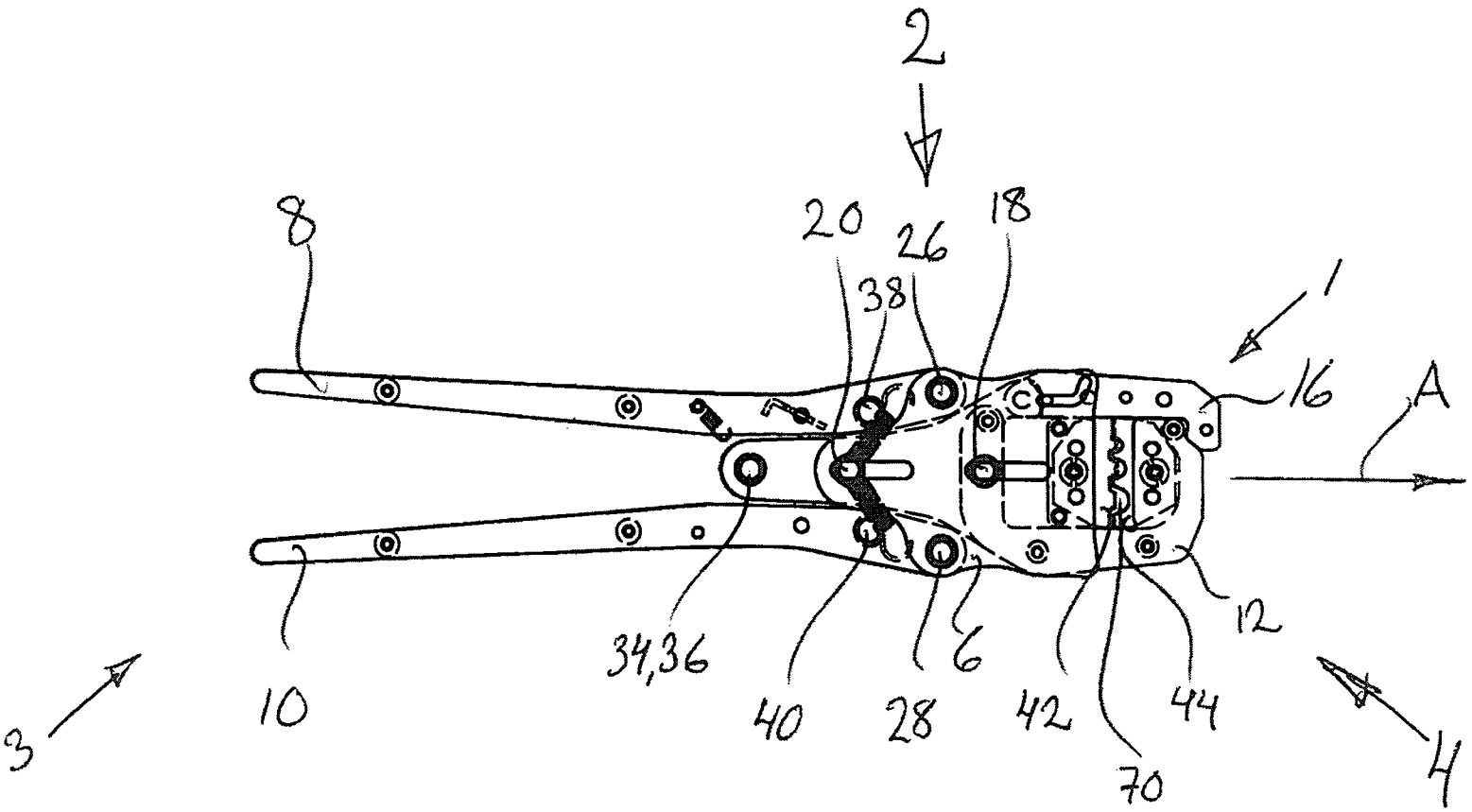
FIG. 3 shows schematically a side view of a hand operated crimping tool having a tool head with a pivotable head part according to the first embodiment of the invention, shown in a closed head position.

FIG. 3 shows schematically a side view of a hand operated crimping tool 2 having a tool head 4 with a pivotable head part 16 according to the first embodiment of the invention, shown in a closed head position.

As can be seen from FIG. 3 when comparing FIG. 1 with FIG. 3, the pivotable head part 16 of the tool head 4 arranged distally 1 on the hand operated crimping tool 2 is automatically moved between an open head position (as shown in FIG. 1) and a closed head position (as shown in FIG. 3) depending on the position of the tool handles 8, 10 arranged proximally 3 on the crimping tool 2, as the movement of the handles 8, 10 is connected to the movement of the pivotable head part 16 of the tool head 4, more specifically to the movement of both the main head part 12 and the pivotable head part 16 of the tool head 4. This is accomplished by arranging the main head part 12 axially slidable along the body 6, by arranging the pivotable head part 16 pivotally to the main head part 12 and pivotally slidable along the body 6, by arranging the handles 8, 10 pivotally to the body 6, and by connecting the respective handles 8, 10 to the main head part 12 via respective toggles 30, 32 pivotally arranged to the main head part 12 and to the respective handles 8, 10, as has been discussed in connection with FIG. 1.

When the handles 8, 10 are pressed together, the handles 8, 10 pivot around their respective pivot point 26, 28 arranged on the body 6, whereby the toggles 30, 32 pivot around their respective distal pivot point 38, 40 arranged on the respective handle 8, 10, thereby moving their respective proximal pivot point 34, 36 where they are pivotally attached to the main head part 12 proximally along the crimping tool 2, thus moving the distal end of the tool head 4 proximally along the crimping tool 2 towards the body 6. This results in that the distal crimping die 44 arranged at the main head part 12 is moved by a toggle mechanism towards the proximal crimping die 42 arranged at the body 6, the crimping dies 42, 44 thus being arranged to be brought towards each other in order to crimp at least one workpiece (not shown in this embodiment) arranged in a crimping aperture 70 arranged between the crimping dies 42, 44. When parting the tool handles 8, 10, the tool head 4 moves in the opposite direction, i.e. from the position shown in FIG. 3 towards the position shown in FIG. 1. This parting of the handles 8, 10 may be executed manually by the user or automatically by a return spring (not shown) when the force pressing the tool handles 8, 10 towards each other is released.

When at least two pins 18, 20 are used in order to control the movement of the main head part 12 relative to the body 6, the above discussed arrangement of the toggles 30, 32 enables arranging the pins 18, 20 far apart this increasing the alignment of the main head part 12 with the tool 2 axis A and decreasing the possible tilt between the tool 2 axis A and the main head part 12.

Figure 4:
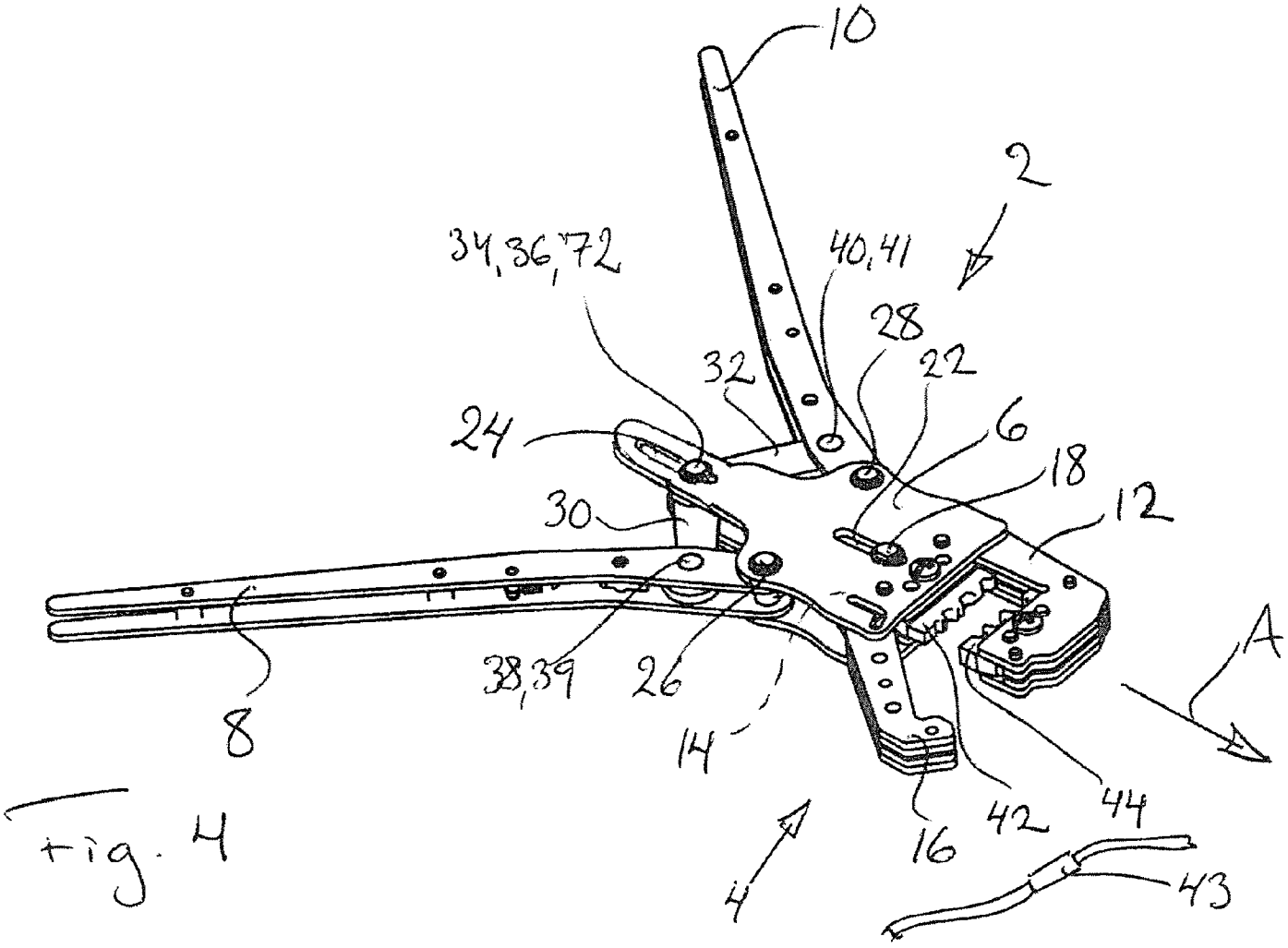
FIG. 4 shows schematically a view of a hand operated crimping tool having a tool head with a pivotable head part according to a third embodiment of the invention, shown in an open head position.

FIG. 4 shows schematically a view of a hand operated crimping tool 2 having a tool head 4 with a pivotable head part 16 according to a third embodiment of the invention, shown in an open head position.

The embodiment shown in FIG. 4 differs from the embodiment shown in FIG. 1 in that the proximal pin 20 shown in FIG. 1 and the pin 35 arranged at the proximal end of the main head part 12 shown in FIG. 1 are substituted by one pin 72 only in the FIG. 4 embodiment, and in that the body 6 and the proximal slot 24 extending axially A along the tool 2 in the FIG. 4 embodiment are arranged to extend correspondingly longer as is shown in FIG. 4.

Thus, according to the embodiment shown in FIG. 4, the tool head 4 comprises a main head part 12 and a pivotably thereto at a pivot point 14 attached pivotable latch-like head part 16, where the main head part 12 is arranged to extend along the body 6 and is slidably attached to the body 6 using pins 18, 72 arranged to slide in respective slots 22, 24 extending axially A along the tool 2, where preferably at least two pins 18, 72 are used in order to control the movement of the main head part 12 relative to the body. The slots 22, 24 may be arranged in the body 6 or in the main head part 12, and the pins may be arranged in the main head part 12 or in the body 6, respectively. The handles 8, 10 are pivotably attached to the body 6 at pivot points 26, 28. The handles 8, 10 are further connected to the main head part 12 by respective toggles 30, 32 which toggles 30, 32 are pivotably attached to the main head part 12 and a respective handle 8, 10 at pivot points 34, 36; 38, 40, preferably by using pins 72; 39, 41. Crimping dies 42, 44 are further, preferably removably, arranged at the body 6 and the main head part 12, respectively, between which crimping dies 42, 44 at least one workpiece 43 is arranged to be crimped when the crimping dies 42, 44 are moved towards each other.

Figure 5:
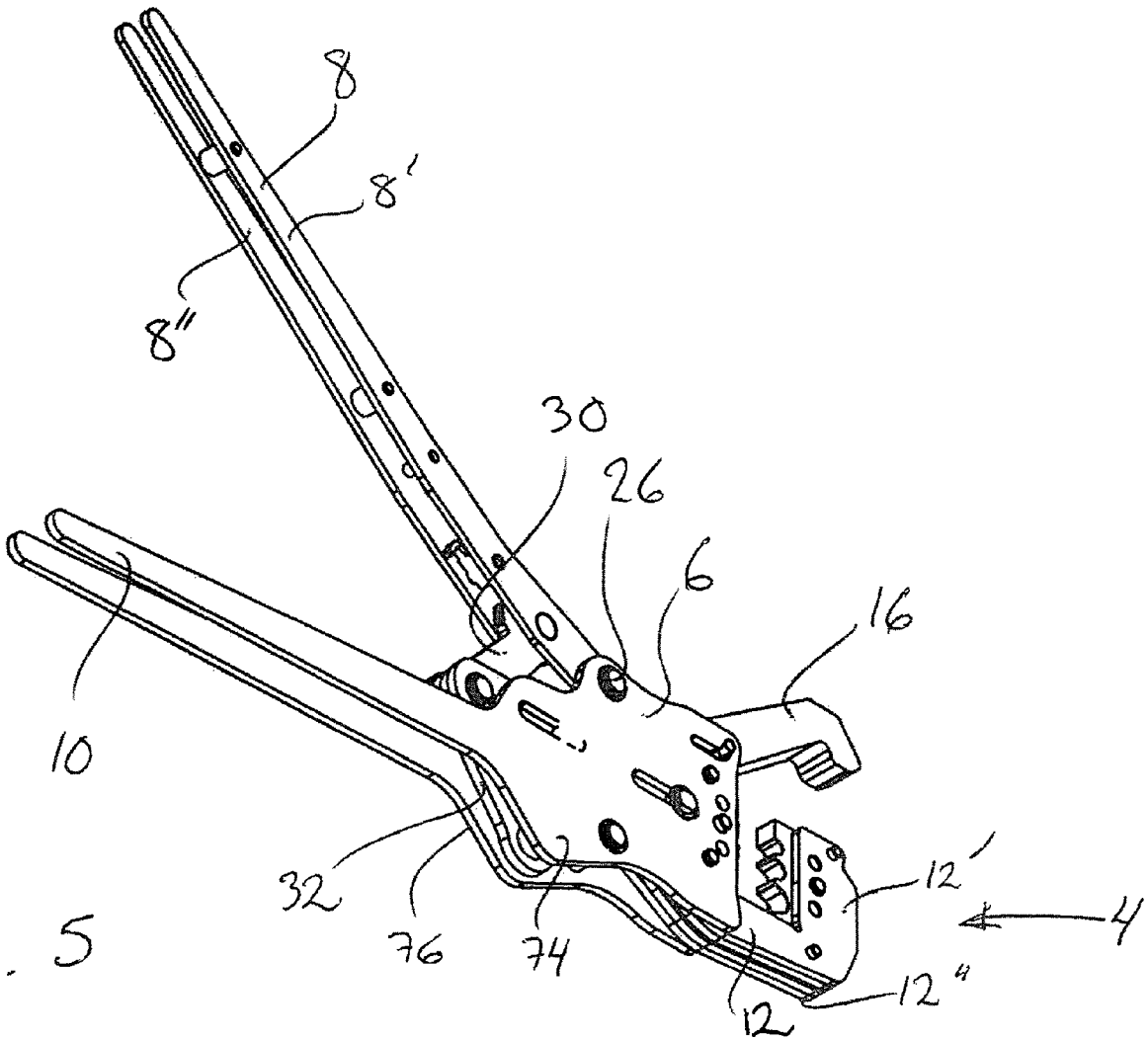
FIG. 5 shows schematically a view of a hand operated crimping tool having a tool head with a pivotable head part according to a fourth embodiment of the invention, shown in a non-crimping position.

FIG. 5 shows schematically a view of a hand operated crimping tool 2 having tool head 4 with a pivotable head part 16 according to a fourth embodiment of the invention, shown in a non-crimping position.

The embodiment shown in FIG. 5 differs from the embodiment shown in FIG. 1 in that only one handle 8 is pivotably attached to the body 6 at a pivot point 26 whereas the other handle 10 is fixed to the body 6. As is shown in the figure, the body 6 preferably comprises two body parts 74, 76 between which the tool head unit 11 is arranged to slide.

As can be seen in FIG. 4 (and which also applies to all the other embodiments described herein), e.g. the handles 8, 10, the main head part 12, or the pivotable head part 16 may comprise a number of, preferably plate-like, sub-parts. E.g., a handle 8 may comprise two sub-parts 8', 8", and the proximal part of the main head part 12 may comprise at least two sub-parts 12', 12" between which at least one toggle 30, 32 may be arranged.

Figure 6:
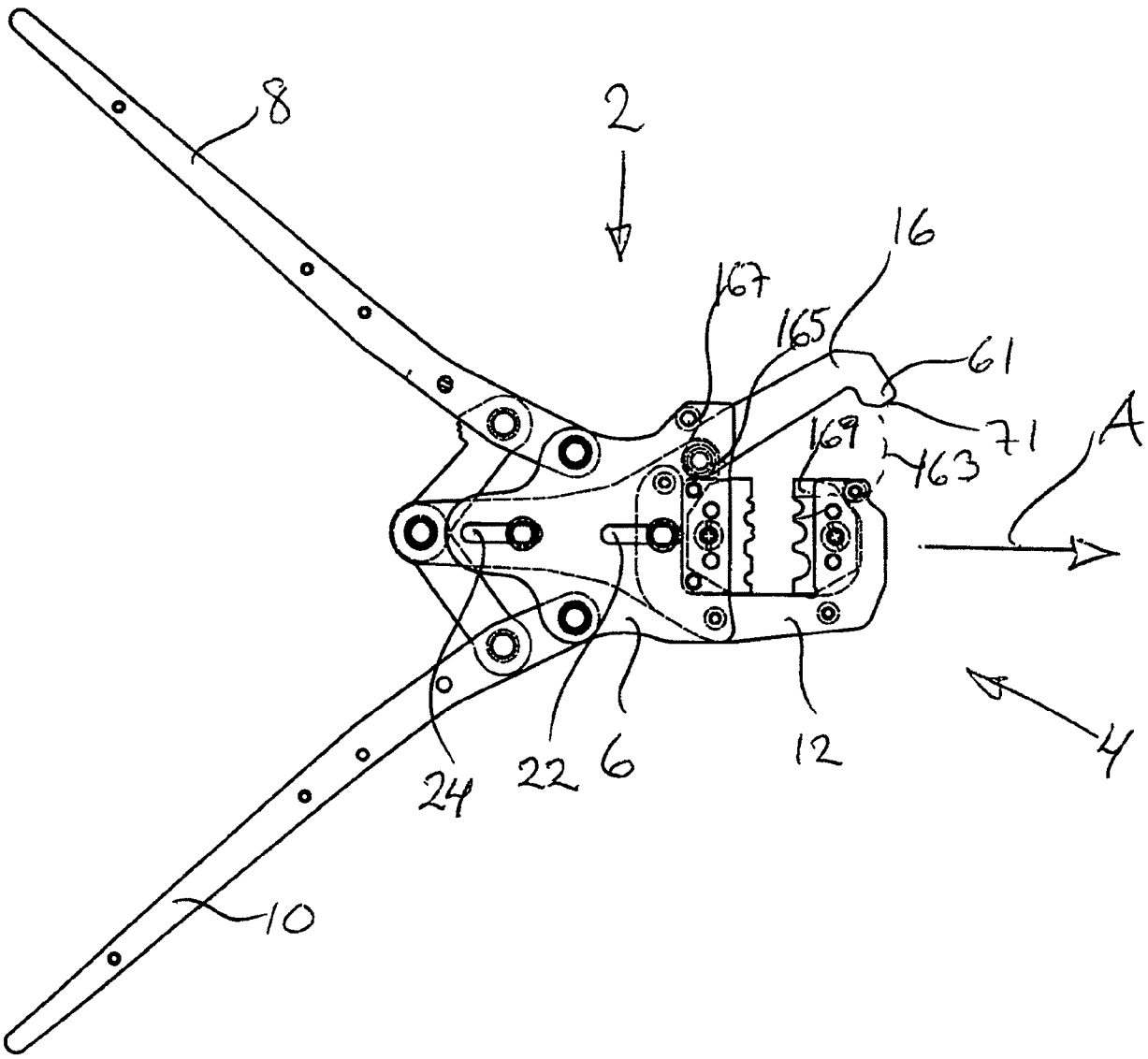
FIG. 6 shows schematically a view of a hand operated crimping tool having a tool head with a pivotable head part according to a fifth embodiment of the invention, shown in a non-crimping position.

FIG. 6 shows schematically a view of a hand operated crimping tool 2 having tool head 4 with a pivotable head part 16 according to a fifth embodiment of the invention, shown in a non-crimping position, The embodiment shown in FIG. 6 differs from the embodiment shown in FIG. 1 in that in order to achieve that pivotable head part 16 of the tool head is automatically adjusted between an open head position and a closed head position depending on the position of the tool handles 8, 10, the free end 61 of the pivotable head part 16 is further arranged to be slidably guided along a curved path 163 in relation to the body 6 by arranging a pre-tensioned spring 165 arranged to push the free end 61 of the pivotable head part 16 away from the main head part 12, and arranging a support means 167 in the body 6 along which the pivotable head part 16 is arranged to slide, the design of the contact surfaces between the support means 167 and the pivotable head part 16 defining the curved path 163. The support means 167 may e.g be a pin or a wheel.

The curved path 163 is arranged at its proximal end 169 to extend in parallel with the above mentioned slots 22, 24 extending axially A along the tool 2, whereas the curved path 163 is arranged towards its distal end 71 to extend at an angle to and away from the above mentioned slots 22, 24. Thus, when the free end 61 of the pivotable head part 16 moves along the curved path 163 in parallel to the above mentioned slots 22, 24, the pivotable head part 16 of the tool head 4 is kept in its closed position. When the free end 61 of the pivotable head part 16 moves along the curved path 163 at an angle to and away from the above mentioned slots 22, 24, the pivotable head part 16 of the tool head 4 leaves its closed position and opens up. When free end 61 of the pivotable head part 16 reaches its most distal position along the curved path 163, the pivotable head part 16 of the tool head 4 has reached its open position.

Figure 7:
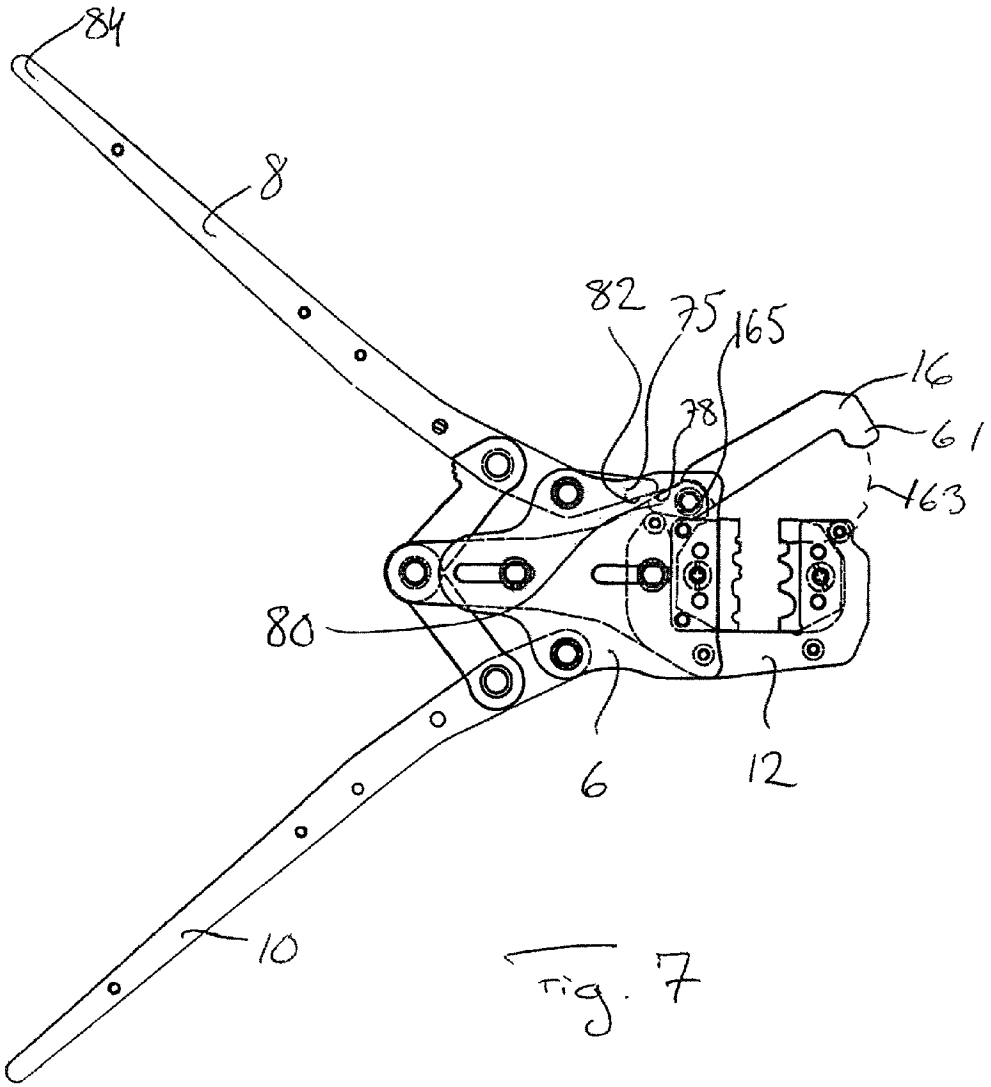
FIG. 7 shows schematically a view of a hand operated crimping tool having a tool head with a pivotable head part according to a sixth embodiment of the invention, shown in a non-crimping position.

FIG. 7 shows schematically a view of a hand operated crimping tool 2 having tool head 4 with a pivotable head part 16 according to a sixth embodiment of the invention, shown in a non-crimping position.

The embodiment shown in FIG. 7 differs from the embodiment shown in FIG. 1 in that in order to achieve that the pivotable head part 16 of the tool head 4 is automatically moved between an open head position and a closed head position depending on the position of the tool handles 8, 10, a cam surface 78 at the to the body 6 attached end 80 of the pivotable head part 16 is arranged to be slidably guided along a cam surface 82 at to the body 6 attached end 75 of a pivotably to the body 6 arranged handle 8. Said cam surface 78 of the pivotable head part 16 is arranged to pivot in the opposite direction of the distal free end 61 of the pivotable head part 16, and said cam surface 82 on the handle 8 is arranged to pivot in the opposite direction of the proximal free end 84 of the handle 8. A pre-tensioned spring 165 is arranged to push the free end 61 of the pivotable head part 16 against the main head part 12, thereby pushing the cam surface 78 of the pivotable head part 16 towards the cam surface 82 on the handle 8. Thus, when the handles 8, 10 are moved apart, the cam surface 82 on the handle pushes against the pivotable head part 16 thereby opening the tool head against the force of the spring 165, and when the handles 8, 10 are moved towards each other, the pivotable head part is no longer blocked by the cam surface 82 on the handle 8 and may move towards the main head part 12 thus closing the tool head.

The free end 61 of the pivotable head part 16 is thus arranged to be slidably guided along a curved path 163 in relation to the body 6, where the design of the cam surfaces define the curved path 163.

Figure 8:
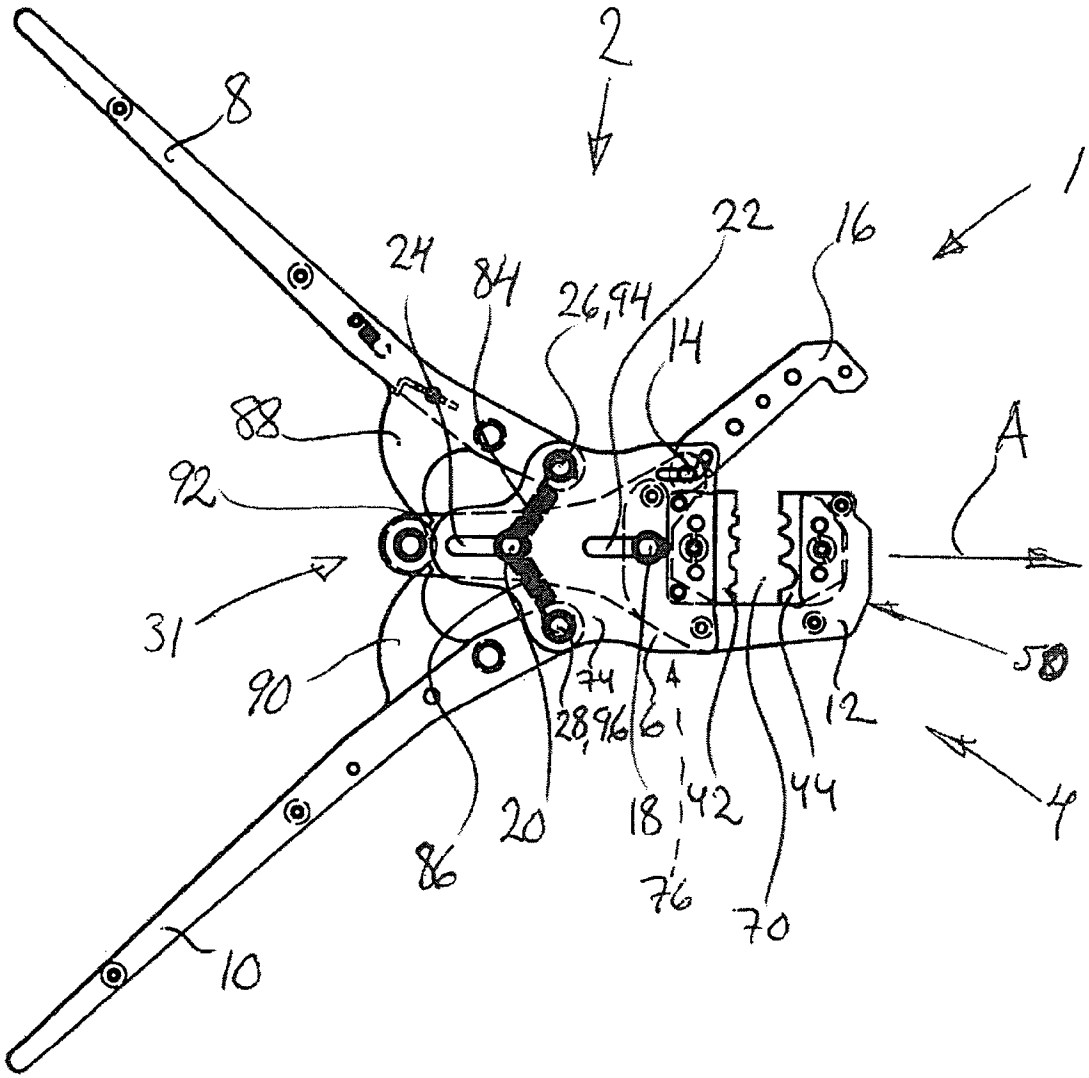
FIG. 8 shows schematically a side view of a hand operated crimping tool having a tool head with a pivotable head part according to a seventh embodiment of the invention, shown in a non-crimping position.

FIG. 8 shows schematically a side view of a hand operated crimping tool 2 having tool head 4 with a pivotable head part 16 according to an seventh embodiment of the invention, shown in a non-crimping position.

As can be seen in FIG. 8 (and which also applies to all the other embodiments described herein), at least one return spring 84, 86, in this embodiment two return springs 84, 86, may be arranged to move the tool handles 8, 10 apart when the force pressing the tool handles 8, 10 towards each other is released, thus moving the distal end 50 of the tool head 4 away from the body 6.

The embodiment shown in FIG. 8 differs from the embodiment shown in FIG. 1 in that the movement of the pivotally to the body 6 arranged handles 8, 10 is arranged connected to the movement of the main head part 12 by a mechanism 31, which here is a cam mechanism, whereby the main head part 12 and the pivotable head part 16 is arranged movable between a non-crimping position and a crimping position depending on the position of the tool handles 8, 10 the pivotable head part 16 thus being automatically movable between an open head position and a closed head position depending on the position of the tool handles 8, 10.

The body 6 is arranged between the distal end 1 and the proximal end 3 of the crimping tool 2. The tool head 4 is arranged distally 1 on the crimping tool 2, and the two handles 8, 10 are arranged proximally 3 on the crimping tool 2. The tool head 4 comprises a main head part 12 and a pivotably thereto at a pivot point 14 attached pivotable latch-like head part 16, where the main head part 12 is arranged to extend along the body 6. The body 6 preferably comprises two body parts 74, 76 between which the main head part 12 is arranged to slide. For clarity, the parts of the main head part 12 which are obscured by the body part 74 are shown with dashed lines in the figure. The tool head unit is slidably attached to the body 6 using pins 18, 20 arranged to slide in respective slots 22, 24 extending axially A along the tool 2, where preferably at least two pins 18, 20 are used in order to control the movement of the main head part 12 relative to the body 6. The slots 22, 24 may be arranged in the body 6 or in the main head part 12, and the pins may be arranged in the main head part 12 or in the body 6, respectively. The handles 8, 10 are pivotably attached to the body 6 at pivot points 26, 28.

The main head part 12 is arranged axially A slidable along the body 6. Crimping dies 42, 44 are further, preferably removably, arranged at the body 6 and the main head part 12, respectively, between which crimping dies 42, 44 at least one workpiece (not shown in this figure) is arranged to be crimped when the crimping dies 42, 44 are moved towards each other. The relative movement of the tool handles 8, 10 is connected to the relative movement of crimping dies 42, 44. For better understanding of the invention, the parts of the crimping dies 42, 44 which are obscured e.g. by one body part 74 or the main head part 12 are shown with dashed lines in the figure.

The handles 8, 10 are further connected to the main head part 12 of the tool head 4 by a mechanism 31 which is a cam mechanism comprising at least one cam 88, 90, in this embodiment two cams 88, 90, which cams 88, 90 are attached to a respective handle 8, 10, and which cams are arranged to engage an at the main head part 12 arranged cam following means 92 such as e.g. a pin arranged on the main head part 12.

When the handles 8, 10 are pressed together, the handles 8, 10 pivot around their respective pivot point 26, 28 arranged on the body 6, whereby the respective cams 88, 90 are moved towards the cam following means 92. When the respective cams 88, 90 engage the cam following means 92, the cam following means 92 arranged on the main head part 12 is moved together with the main head part 12 proximally along the crimping tool 2, thus moving the distal end 50 of the tool head 4 proximally along the crimping tool 2 towards the body 6. This results in that the distal crimping die 44 arranged at the main head part 12 is moved by a cam mechanism towards the proximal crimping die 42 arranged at the body 6, the crimping dies 42, 44 thus being arranged to be brought towards each other in order to crimp at least one workpiece (not shown in this embodiment) arranged in a crimping aperture 70 arranged between the crimping dies 42, 44. When the main head part 12 moves proximally along the body 6, the return springs 84, 86 arranged between the main head part 12 and the body 6, e.g. arranged between a pin 20 arranged on the main head part 12 and a respective pin 94, 96 arranged on the body 6, are tensioned thereby increasing a return spring force trying to move the tool handles 8, 10 apart. Thus, when the force pressing the tool handles 8, 10 towards each other is released, the return spring force from the tensioned return springs 84, 86 is arranged to move the tool handles 8, 10 apart thus moving the distal end 50 of the tool head 4 in the opposite direction away from the body 6.

As mentioned in the different embodiments above, the main head part 12 is slidably attached to the body 6 using at least one pin arranged to slide in at least one slot, and the pivotable head part 16 is further arranged to be slidably guided along a curved path along the body 6 by using at least one pin arranged to slide in a curved slot. The body 6 preferably comprises two body parts 74, 76 between which the main head part 12 is arranged to slide.

The main head part 12 is preferably slidably attached to both body parts 74, 76 of the body 6, e.g. by using at least one pin attached to both body parts 74, 76 and arranged to slide in at least one slot in the main head part 12, or using at least one pin attached to the main head part 12 and arranged to slide in at least one slot arranged in each of the body parts 74, 76.

The pivotable head part 16 is further preferably arranged to be slidably guided along a curved path along both body parts 74, 76 of the body 6, e.g. by using at least one pin attached to both body parts 74, 76 and arranged to slide in a curved slot in the pivotable head part 16, or by using at least one pin attached to the pivotable head part 16 and arranged to be slidably guided along a curved slot arranged in each of the body parts 74, 76. Another possible embodiment is to arrange the free end 61 of the pivotable head part 16 to be slidably guided along a curved path 63 in relation to the body 6 by arranging a pre-tensioned spring 65 arranged to push the free end 61 of the pivotable head part 16 away from the main head part 12, and arranging a support means 67 in the body 6 along which the pivotable head part 16 is arranged to slide, as mentioned above. A further possible embodiment is to arrange the free end 61 of the pivotable head part 16 to be slidably guided along a curved path 63 in relation to the body 6 by arranging a pre-tensioned spring 65 arranged to push the free end 61 of the pivotable head part 16 against the main head part 12, and arranging a cam surface 72 at the to the body 6 attached end 74 of the pivotable head part 16 is to be slidably guided along a cam surface 76 at to the body 6 attached end of a pivotably to the body 6 arranged handle 8, as mentioned above. The curved path 63 is arranged at its proximal end 69 to extend in parallel with the above mentioned slots 22, 24 extending axially A along the tool 2, whereas the curved path 63 is arranged towards its distal end 71 to extend at an angle to and away from the above mentioned slots 22, 24.

Figure 9:
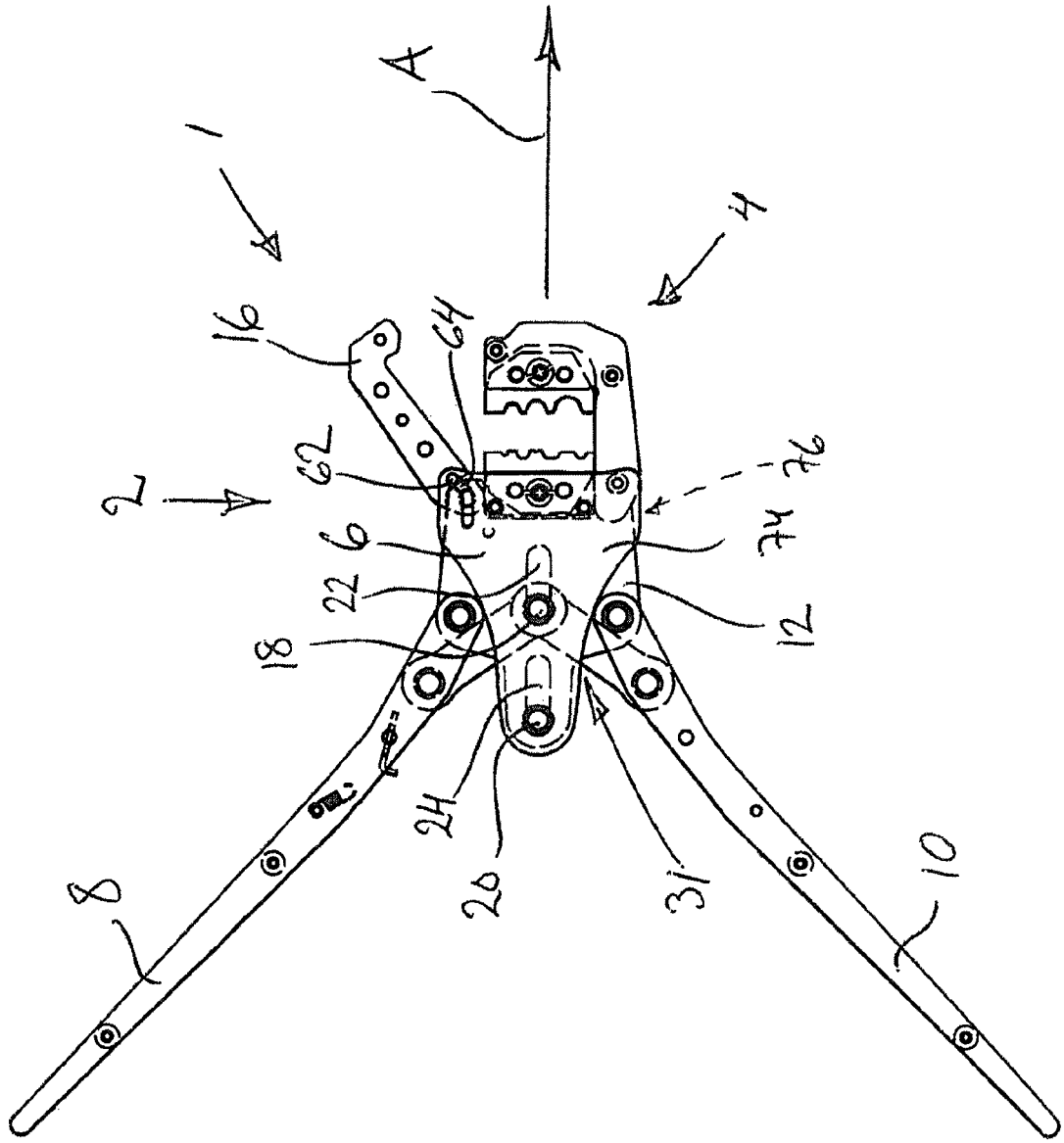
FIG. 9 shows schematically a side view of a hand operated crimping tool having a tool head with a pivotable head part according to an eight embodiment of the invention, shown in a non-crimping position.

FIG. 9 shows schematically a side view of a hand operated crimping tool 2 having a tool head 4 with a pivotable head part 16 according to an eight embodiment of the invention, shown in a non-crimping position.

The embodiment shown in FIG. 9 differs from the embodiment shown in FIG. 1 in that in order to achieve that the pivotable head part 16 of the tool head 4 is arranged automatically movable between an open head position and a closed head position depending on the relative position of the tool handles 8, 10, the at least one pivotable handle 8, 10 is arranged pivotally to the main head part 12, and the body 6 is arranged axially A slidable along the main head part 12 and further arranged during the sliding movement to control the pivoting movement of the pivotable head part 16.

FIG. 9 thus shows a hand operated crimping tool 2 comprising a body 6 arranged between a distal end 1 and a proximal end 3 of the crimping tool 2, a tool head 4 arranged distally 1 on the crimping tool 2, and handles 8, 10 arranged proximally 3 on the crimping tool 2, where in this embodiment two handles 8, 10 are pivotally arranged to the main head part 12, the pivotable head part 16 is pivotally arranged to the main head part 12, the body 6 is arranged axially A slidable along the main head part 12 and further arranged during the sliding movement to control the pivoting movement of the pivotable head part 16 and where a mechanism 31 is arranged to connect the movement of the pivotally to the main head part 12 arranged handles 8, 10 to the movement of the body 6 and the pivotable head part 16. The body 6 is arranged slidably attached to the main head part 12 using at least one pin 18, 20 arranged to slide in at least one slot 22, 24 extending axially A along the tool 2. The pivotable head part 16 is further arranged to be slidably guided along a curved path along the body 6 by using at least one pin 62 arranged to slide in a curved slot 64 defining the curved path. The body 6 preferably comprises two body parts 74, 76 between which the main head part 12 is arranged. The parts, e.g. the slots 22, 24, which are obscured e.g. by the body 6 are shown with dashed lines in the figure.

Figure 10:
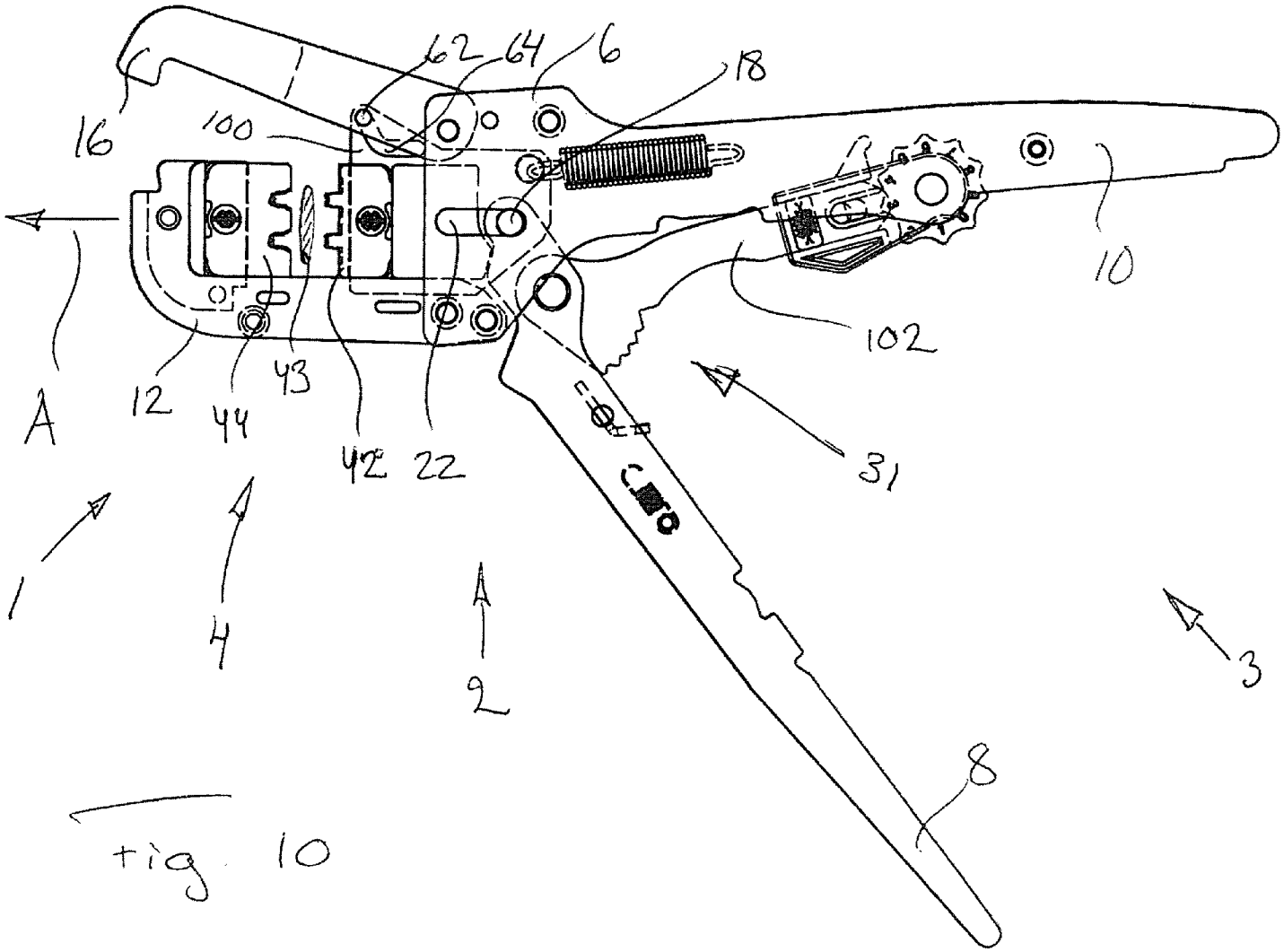
FIG. 10 shows schematically a side view of a hand operated crimping tool having a tool head with a pivotable head part according to a ninth embodiment of the invention, shown in a non-crimping position.

FIG. 10 shows schematically a side view of a hand operated crimping tool 2 having a tool head 4 with a pivotable head part 16 according to a ninth embodiment of the invention, shown in a non-crimping position.

The embodiment shown in FIG. 10 shows a hand operated crimping tool 2 comprising a body 6 arranged between a distal end 1 and a proximal end 3 of the crimping tool 2, a tool head 4 arranged distally 1 on the crimping tool 2, and handles 8, 10 arranged proximally 3 on the crimping tool 2, where at least one handle 8, 10 is pivotally arranged, in this embodiment only one handle 8 is shown pivotably arranged, and where the relative movement of the tool handles 8, 10 is connected to the relative movement of crimping dies 42, 44 between which crimping dies 42, 44 at least one workpiece 43 is arranged to be crimped, the tool head 4 comprising a main head part 12 and a pivotable head part 16, and where the movement of the at least one pivotally arranged handle 8, 10 is further arranged connected to the movement of the pivotable head part 16 via the body 6 and a mechanism 31, whereby the pivotable head part 16 of the tool head 4 is arranged movable between an open head position and a closed head position depending on the relative position of the tool handles 8, 10. In this embodiment, the at least one pivotally arranged handle 8, 10 is pivotally arranged to the body 6, the body 6 and the main head part 12 are arranged fixed to each other, and the pivotable head part 16 is pivotally fixed to the body 6 or the main head part 12, i.e. the pivotable head part 16 is pivotally arranged to the main head part 12 and the body 6. In this embodiment the mechanism 31 is arranged to connect the movement of the at least one pivotally to the body 6 arranged handle 8, 10 to the movement of the pivotable head part 16, and the pivotable head part 16 is further arranged to be slidably guided along a curved path along the body 6 by using at least one pin 62 arranged to slide in a curved slot 64 defining the curved path. In this embodiment, the mechanism 31 comprices a device 100 in which the curved slot 64 is arranged, which device 100 is arranged slidably attached to the body 6 and arranged to move axially A along the body 6 together with the proximal die 42 when handle 8 is moved using at least one pin 18 arranged to slide in at least one slot 22 by which pin 18 the handle 8 is pivotally arranged to the device 100 and pivotally slidably arranged to the body 6, a toggle 102 being pivotably arranged to the handles 8, 10, whereby the pin 62 arranged in the pivotable head part 16 is arranged to move along the curved slot 64 thus controlling the movement of the pivotable head part 16.

The mechanism 31 connecting the handles and the tool head is preferably a toggle mechanism or a cam mechanism as discussed in the embodiments above, but may also be another mechanism which in a similar way connects the movement of the at least one pivotable handle and the movement of the tool head, such as e.g. a toothed wheel mechanism.

The features of the embodiments discussed above may be combined in further ways than those explicitly described in the embodiments above. The invention thus relates to a hand operated crimping tool comprising a body arranged between a distal end and a proximal end of the crimping tool, a tool head arranged distally on the crimping tool, and handles arranged proximally on the crimping tool, where at least one handle is pivotally arranged, and where the relative movement of the tool handles is connected to the relative movement of crimping dies between which crimping dies at least one workpiece is arranged to be crimped, the tool head comprising a main head part and a pivotable head part, where the movement of the at least one pivotally arranged handle is further arranged connected to the movement of the pivotable head part via the body and a mechanism, whereby the pivotable head part of the tool head is arranged movable between an open head position and a closed head position depending on the relative position of the tool handles.

What is claimed is:

1. Hand operated crimping tool comprising a body arranged between a distal end and a proximal end of the crimping tool, a tool head arranged distally on the crimping tool, and handles arranged proximally on the crimping tool, where at least one handle is pivotally arranged, and where the relative movement of the tool handles is connected to the relative movement of crimping dies between which crimping dies at least one workpiece is arranged to be crimped, the tool head comprising a main head part and a pivotable head part, wherein the movement of the at least one pivotally arranged handle is further arranged connected to the movement of the pivotable head part via the body and a mechanism, wherein the mechanism comprises at least one of a toggle mechanism and a cam mechanism, whereby the pivotable head part of the tool head is arranged movable between an open head position and a closed head position depending on the relative position of the tool handles, and wherein the at least one pivotally arranged handle is pivotally arranged to the body, the main head part is arranged axially slidable along the body, and in that the pivotable head part is pivotally arranged to the main head part and arranged a curved path along the body.

2. Hand operated crimping tool according to claim 1, wherein the two handles are arranged pivotally to the body.

3. Hand operated crimping tool according to claim 1, wherein the mechanism is arranged to connect the movement of the at least one pivotally to the body arranged handle to the movement of the main head part and the pivotable head part, and that the mechanism is the toggle mechanism.

4. Hand operated crimping tool according to claim 3, wherein the two pivotally to the body arranged handles are connected to the main head part by respective toggles pivotably attached to the main head part and the respective handles.

5. Hand operated crimping tool according to claim 1, wherein the mechanism is arranged to connect the movement of the at least one pivotally to the body arranged handle to the movement of the main head part and the pivotable head part, and that the mechanism is the cam mechanism.

6. Hand operated crimping tool according to claim 5, wherein the cams attached to two pivotally to the body arranged handles are arranged to engage an at the main head part arranged cam following means, and that at least one return spring is arranged between the main head part and the body.

7. Hand operated crimping tool according to claim 1, wherein the main head part is arranged slidably attached to the body using at least one pin arranged to slide in at least one slot extending axially along the tool.

8. Hand operated crimping tool according to claim 7, wherein the main head part is arranged slidably attached to the body using at least two pins arranged to slide in at least one slot extending axially along the tool.

9. Hand operated crimping tool according to claim 7, wherein the at least one slot is arranged in the main head part, and the at least one pin is arranged in the body.

10. Hand operated crimping tool according to claim 7, wherein the at least one slot is arranged in the body, and the at least one pin is arranged in the main head part.

11. Hand operated crimping tool according to claim 1, wherein the pivotable head part is further arranged to be slidably guided along a curved path along the body by using at least one pin arranged to slide in a curved slot defining the curved path, where the curved slot is arranged in the body, and the at least one pin arranged to slide in the curved slot is arranged in the pivotable head part.

12. Hand operated crimping tool according to claim 11, wherein the curved slot is arranged at its proximal end to extend in parallel with slots extending axially along the tool, whereas the currved slot is arranged towards its distal end to extend at an angle to and away from the slots that extend axially along the tool.

13. Hand operated crimping tool according to claim 12, wherein the slots are arranged in the body.

14. Hand operated crimping tool according to claim 1, wherein the pivotable head part is further arranged to be slidably guided along a curved path along the body by using at least one pin arranged to slide in a curved slot defining the curved path, where the curved slot is arranged in the pivotable head part, and at least one pin is arranged in the body.

15. Hand operated crimping tool according to claim 14, wherein the curved slot is in the closed position of the pivotable head part of the tool head arranged at its distal end to extend in parallel with the said slots extending axially along the tool, and arranged towards its proximal end to extend at an angle to the distal end of the curved slot and away from the said slots.

16. Hand operated crimping tool according to claim 1, wherein the free end of the pivotable head part is further arranged to be slidably guided along a curved path in relation to the body by arranging a pre-tensioned spring arranged to push the free end of the pivotable head part away from the main head part, and arranging a support means in the body along which the pivotable head part is arranged to slide, the design of the contact surfaces between the support means and the pivotable head part defining the curved path.

17. Hand operated crimping tool according to claim 16, wherein the curved path is arranged at its proximal end to extend in parallel with the above mentioned slots extending axially along the tool, whereas the curved path is arranged towards its distal end to extend at an angle to and away from the above mentioned slots.

18. Hand operated crimping tool according to claim 1 wherein the free end of the pivotable head part is arranged to be slidably guided along a curved path in relation to the body, by arranging a cam surface at the to the body attached end of the pivotable head part to be slidably guided along a cam surface at the body attached end of a pivotably to the body arranged handle, and where said cam surface of the pivotable head part is arranged to pivot in the opposite direction of the distal free end of the pivotable head part, and said cam surface on the handle is arranged to pivot in the opposite direction of the proximal free end of the handle, and where a pre-tensioned spring is arranged to push the free end of the pivotable head part against the main head part, thereby pushing the cam surface of the pivotable head part towards the cam surface on the handle, where the design of the cam surfaces define the curved path.

19. Hand operated crimping tool according to claim 18, wherein the curved path is arranged at its proximal end to extend in parallel with the above mentioned slots extending axially along the tool, whereas the curved path is arranged towards its distal end to extend at an angle to and away from the above mentioned slots.

20. Hand operated crimping tool according to claim 1, wherein the body comprises two body parts between which the main head part is arranged to slide.

21. Hand operated crimping tool according to claim 20, wherein the main head part is slidably attached to both body parts.

22. Hand operated crimping tool according to claim 20, wherein the pivotable head part is arranged to be slidably guided along a curved path along both body parts by using at least one pin attached to both body parts and arranged to slide in a curved slot in the pivotable head part, or by using at least one pin attached to the pivotable head part and arranged to be slidably guided along a curved slot arranged in each of the body parts.

23. Hand operated crimping tool according to claim 1, wherein the main head part comprises at least one distal part and at least one proximal part, where a crimping die is arranged at the distal end of the distal part and toggles are pivotably attached to the proximal end of the proximal part, and where the distal end of the proximal part is attached to the proximal end of the distal part and where the pivotable head part is pivotably attached to the distal end of the proximal part.

24. Hand operated crimping tool according to claim 1, wherein the at least one pivotally arranged handle is pivotally arranged to the main head part, the pivotable head part is pivotally arranged to the main head part, and in that the body is arranged axially slidable along the main head part and further arranged during the sliding movement to control the pivoting movement of the pivotable head part.

25. Hand operated crimping tool according to claim 24, wherein the mechanism is arranged to connect the movement of the at least one pivotally to the main head part to the movement of the body and the pivotable head part.

26. Hand operated crimping tool according to claim 24, wherein the body is arranged slidably attached to the main head part using at least one pin arranged to slide in at least one slot extending axially along the tool.

27. Hand operated crimping tool according to claim 24, wherein the pivotable head part is further arranged to be slidably guided along a curved path along the body by using at least one pin arranged to slide in a curved slot defining the curved path.

28. Hand operated crimping tool according to claim 24, wherein the body comprises two body parts between which the main head part is arranged.

29. Hand operated crimping tool according to claim 1, wherein the at least one pivotally arranged handle is pivotally arranged to the body, the body and the main head part are arranged fixed to each other, and in that the pivotable head part is pivotally arranged to the main head part and the body.

30. Hand operated crimping tool according to claim 29, wherein the mechanism is arranged to connect the movement of the at least one pivotally to the body arranged handle to the movement of the pivotable head part.

31. Hand operated crimping tool according to claim 30, wherein the pivotable head part is further arranged to be slidably guided along a curved path along the body by using at least one pin arranged to slide in a curved slot defining the curved path.

* * * * *